United States Patent [19]

Quercetti

[11] Patent Number: 4,606,471

[45] Date of Patent: Aug. 19, 1986

[54] CAGE BOX OF PLASTICS WITH AN INTEGRAL COVER

[76] Inventor: Alessandro Quercetti, Strada S. Vito Revigliasco 48, I-10133 Torino, Italy

[21] Appl. No.: 748,610

[22] Filed: Jun. 25, 1985

[30] Foreign Application Priority Data

Jul. 17, 1984 [IT] Italy ..... 53644 B/84

[51] Int. Cl.[4] ..... B65D 1/24; B65D 1/36; B65D 57/00

[52] U.S. Cl. ..... 220/22; 220/339

[58] Field of Search ..... 220/22, 339, 70, 306; 206/3, 372, 443, 478, 804

[56] References Cited

U.S. PATENT DOCUMENTS

| | | | |
|---|---|---|---|
| 3,923,152 | 12/1975 | Minneman | 220/339 |
| 4,034,885 | 7/1977 | Hunckler et al. | 220/22 |
| 4,465,184 | 8/1984 | Bruce | 220/339 |
| 4,541,528 | 9/1985 | Holmes | 220/339 |

*Primary Examiner*—George T. Hall
*Attorney, Agent, or Firm*—Young & Thompson

[57] ABSTRACT

A box, particularly suitable for containing small items, which is made of a semiflexible plastic material, and comprises a box-type body and a cover connected to one another by lamellar hinges; both the walls of the body and the main wall of the cover are formed by a number of material elements between which there are open spaces whose global surface prevails over the global surface of the material elements, thus forming a cage structure. Some material elements have a circular cross-section, others have a trapezoidal cross-section. Portions having no open space extend along the vertical edges of the body and at intervals transversally with respect to the body; separation walls may be formed at the portions having no open space. Massive rims extend all around the body and the cover and both the material elements and the lamellar hinges terminate at the massive rims. From the massive rim of the cover, at the side opposite the lamellar hinges, extends a plaque having, on the inner side, projections adapted to engage, by an elastic snap action, below the massive rim of the box body, thus forming a closure clip. Outer projections extend from the bottom wall of the box body, and form support feet for the box.

9 Claims, 8 Drawing Figures

CAGE BOX OF PLASTICS WITH AN INTEGRAL COVER

BACKGROUND OF THE INVENTION

This invention relates to a box made of plastics, particularly suitable for containing small items.

At the present time, for containing small items, for example game pieces, such as mosaic elements, small hardware, stationary, haberdashery or toilet articles, etc., it is a general practice to use boxes of plastics whose body or at least their cover are made of a trasparent material, because it is generally required that the contents of the box could be examined before opening the box. However, the use of plastics having such a degree of trasparency as to allow a clear vision therethrough involves various disadvantages, among which in particular a higher cost of the boxes as compared with those made of opaque or little trasparent materials, a considerable brittleness, a low agreableness to the touch and the impossibility to form the box with an overturnable cover integral therewith, connected to the box through lamellar hinges. This impossibility is due to the insufficient resistance to repeated bendings of the available plastics having a high degree of trasparency. In fact, boxes having a more or less high degree of trasparency and provided with a cover connected thereto by lamellar hinges are produced only for those cases in which the box is intended to be thrown away after extraction of its contents, such as, in particular, the special boxes having a number of cells intended to contain eggs. On the other hand, a cover integral with the body of the box is highly desirable in view of the resulting impossibility of lossing it and the practicalness of use of the boxes provided with such a cover.

Furthermore, a general disadvantage arising in the manufacture of boxes made by injection moulding of plastics consists in that, in order to obtain a sufficient flow of material, it is unavoidable to give to the walls of the box a thickness considerably higher than that which would be required for resistance purposes, with a consequent considerable waste of material.

Another general disadvantage of the boxes intended to contain small items consists in that such boxes tend to collect dust and foreign matter particles, which remain mixed with the small items contained in the box, thereby soiling them and requiring that, from time to time, the small items are withdrawn from the box in order to blow away the dust before reintroducing the items into the box.

SUMMARY OF THE INVENTION

The object of this invention is to provide a box made of plastics, which, in order to avoid the disadvantages mentioned hereinabove, should be capable of allowing observation of the contents of the closed box, should have an integral cover connected to the body of the box through lamellar hinges capable of resisting to repeated bendings, should be agreable to the touch, should minimize the consumption of material for its manufacture, should not require the use of any particularly expensive material and, moreover, should not allow the accumulation of dust and the like together with the small items contained in the box.

This object is attained, according to the invention, by the fact that the box is made of a semiflexible plastic material, it comprises a box-type body and a cover, connected to one another by lamellar hinges, and has both the walls of the body and the main wall of the cover formed by a number of material elements between which there are open spaces whose global surface prevails over the global surface of the material elements, thus forming a cage structure.

Thanks to these characteristics, the cage box allows an easy observation of the contents, even in the closed condition of the box, by virtue of the prevalence of the surface of the open spaces relative to the the surface of the material elements forming the walls, and this in spite of the fact that the plastics from which the box is made may be non transparent or insufficiently trasparent to allow a clear vision of the contents of the box. The cover connected to the body by means of lamellar hinges cannot be lost and provides a maximum practicalness of use. The use of a semiflexible, relatively economical plastics ensures, at the same time, a satisfactory resistance to repeated bendings of the lamellar hinges and a satisfactory agreableness to the touch. The formation of the walls by means of material elements separated from each other by open spaces allows, through an appropriate choice of the measures, to provide a box having a mechanical resistance not higher than that which is required for its application, and thus to avoid any waste of material, though maintaining a thickness of the elements which is sufficient to ensure a good flow of the material during the injection moulding operation. The cage structure permits the dust and any foreign particles to come out from the box, so that the small items contained therein remain in a clean state.

BRIEF DESCRIPTION OF THE DRAWINGS

These and other characteristics and advantages of the subject of this invention will be more clearly apparent from the following description of an embodiment given by way of non limiting example and diagrammatically shown in the annexed drawings, in which.

DETAILED DESCRIPTION OF A PREFERRED EMBODIMENT

Figure 1:
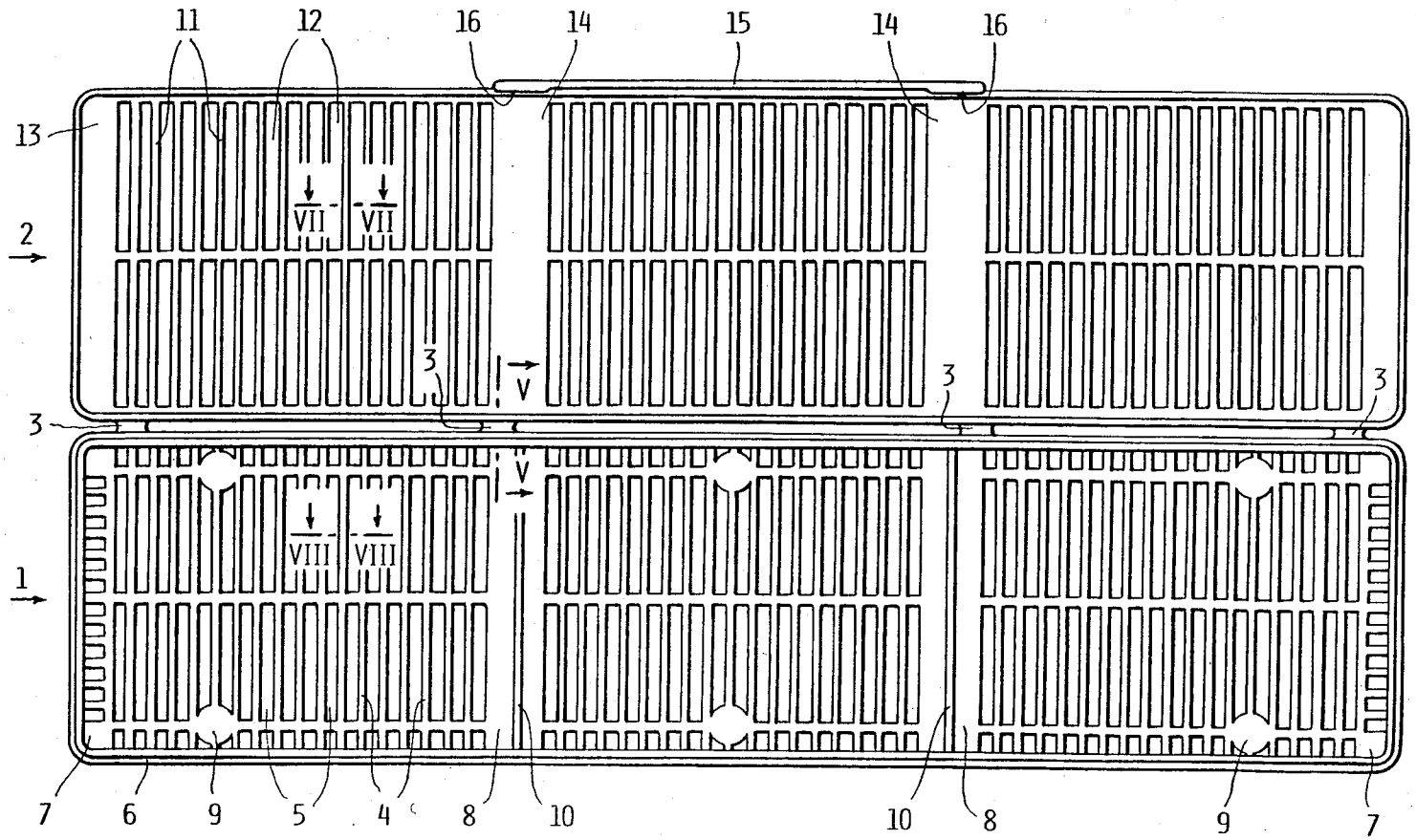
FIG. 1 is a plan view of the box with cover, in its opened condition, as it results from the forming process thereof, seen from inside.

The box shown in the drawings comprises a body, generally indicated by reference numeral 1, and a cover, generally indicated by reference numeral 2, the body 1 and the cover 2 being connected to one another by lamellar hinges 3, and the whole being manufactured as an integral structure made of a semiflexible plastics material such as, for example, a polypropylene.

The bottom and lateral walls of the body 1 of the box are formed by several material elements 4 mutually spaced by open spaces 5, thus forming a cage structure which terminates in its upper portion with a massive rim 6 extending all around the body 1 of the box and having connected thereto the lamellar hinges 3. Portions 7 having no open space are provided along the vertical edges of the body 1, and portions 8, also having no open space, may be provided at intervals transversally with respect to the body 1, if this latter has a length considerably larger than its width, to allow obtaining an appropriate stiffening. This structure is suitable for being dimensioned, as a function of the size and weight of the articles to be contained in the box, in such a manner as to provide an adequate mechanical resistance with the minimum consumption of material. Preferably, the material elements 4 have a trapezoidal cross-section as shown in FIG. 1, or another similar cross-section, which ensures a good exploitation of the resistance of the material, an adequate flow of this latter during the injection process, and an economical manufacture of the moulding die which, this way needs to being hollowed on one of its parts only.

In the bottom wall of the body 1 there may also be provided outer projections 9 forming support feet for the box. Moreover, should it be required by the nature of the articles to be contained in the box, separation walls 10 may subdivide in several portions the inner space of the body 1 of the box. The walls 10 are formed at the portions 8 having no open space in order to ensure, at the time of injection, a flow of material adequate to form the wall 10.

Figures 2, 3, 4, 5, 6, 7, 8:
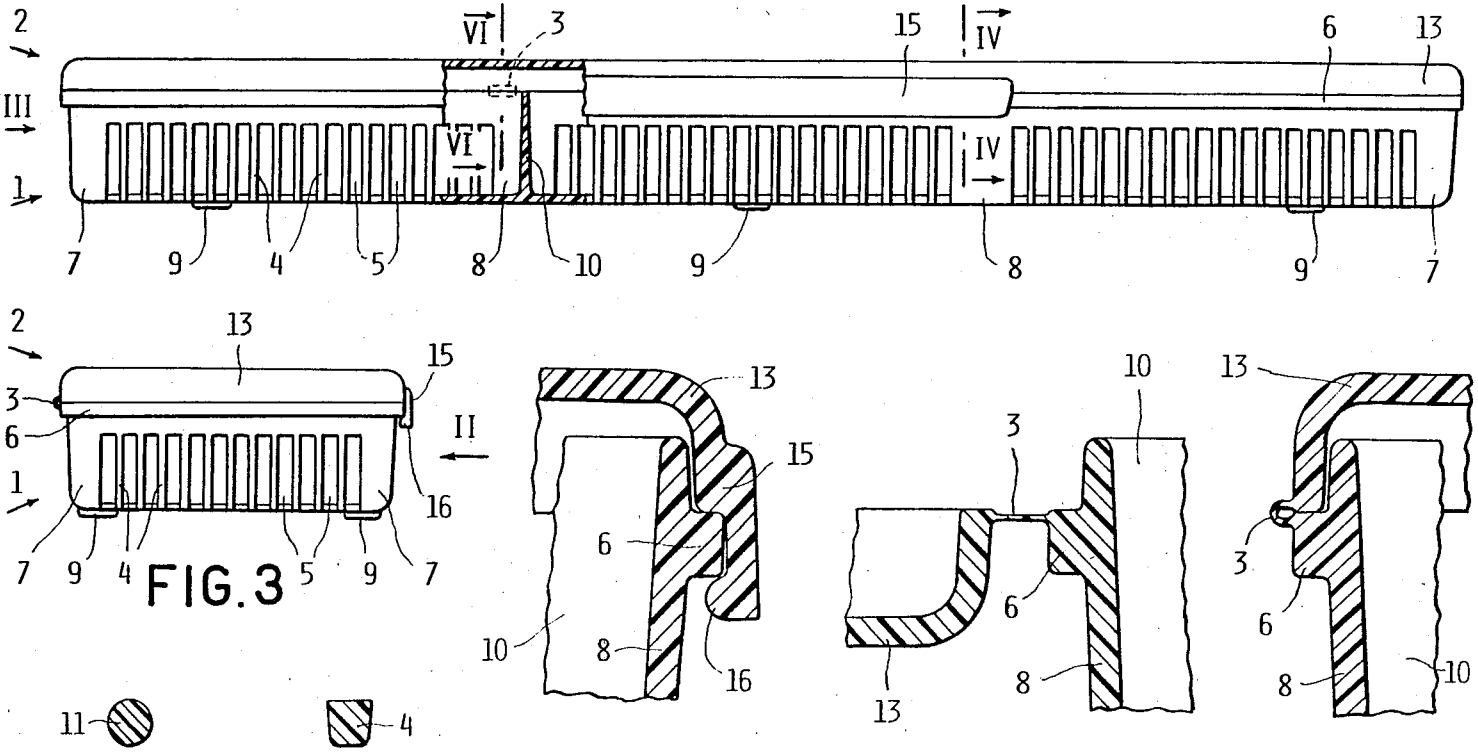
FIG. 2 is a front elevational view of the closed box, a front portion thereof being broken away.
FIG. 3 is an end view thereof.
FIG. 4 is an enlarged sectional view, taken along line III—III of FIG. 2, of a closure clip of the box.
FIG. 5 is a similar sectional view, taken along line V—V of FIG. 1, showing a lamellar hinge in the opened box.
FIG. 6 is a similar sectional view, taken along line VI—VI of FIG. 2, showing a lamellar hinge in the closed box.
FIG. 7 shows on a larger scale a sectional view, taken along line VII—VII of FIG. 1, of a material element of the cover wall.
FIG. 8 similarly shows a sectional view, taken along line VIII—VIII of FIG. 1, of a material element of the wall of the box body.

Similarly to what has been described for the body 1 of the box, the cover 2 of this latter has a main wall formed by a plurality of material elements 11 mutually spaced by open spaces 12, thus forming a cage structure which terminates, in its lower portion, with a massive rim 13 which extends all around the cover 2 of the box and to which the lamellar hinges 3 are connected. Portions 14 having no open spaces may be provided at intervals trasversally with respect to the cover 2, similarly to what has been said for the body 1, if the box has a length considerable larger than its width. Preferably, the material elements 11 have a substantially circular cross-section, as shown in FIG. 7, or a similar cross-section, which ensures, together with a good exploitation of the resistance of the material, a maximum visibility of the contents of the box through the resultant structure, whichever the angle of observation may be. All this is obtained while still ensuring an adequate flow of the material during the injection process.

Advantageously, the cover 2 is provided on its rim 13, at the side opposite the lamellar hinges 3, with a closure clip, formed by a plaque 15 projecting downwards and having, on the inner side, projections 16 adapted to engage, by an elastic snap action, below the rim 6 of the body of the box. This simple arrangement ensures a stable closure of the box, which prevents this latter from being accidentally opened with a consequent dispersion of the contents, but does not hinder the deliberate opening thereof which may be carried out by a little force.

The box according to the present invention is particularly economical, in spite of the cost of the necessary dies, thanks to both the great economy in the material required for its manufacture and the possibility of using a plastic material less expensive than those having a high transparency. This box is suitable for containing small items for a long period of use, thanks to the possibility of choosing for its manufacture of plastic material which ensures a long life of the lamellar hinges 3. Moreover, after the termination of its specific uses, i.e. after having consumed the articles contained therein, this box may be reused for several further applications, among which, for example, as a cage for placing therein insects or other small animals, even living ones.

Of course the configuration of the various parts of the box, and its dimensions and proportions, may vary in accordance with the application requirements and the nature and quantity of the articles intended to be contained therein. In particular, of course, the width of the open spaces 5 and 12 should be chosen reduced enough to prevent the articles contained in the box from coming out therefrom. The shape of the material elements 4 and 11, which have been shown as being formed by rectilinear bars, may be various, and it may be oriented in any direction, even if not parallel to the sides of the box; the shape of the material elements and that of the spaces separating these latter may be chosen in such a manner as to form an ornamentation, to reproduce a trademark, and so on.

I claim:

1. A box, particularly suitable for containing small items, which is made of a semiflexible plastic material, and comprises a box-type body, a cover and lamellar hinges connecting to one another said body and said cover, both the walls of the body and the main wall of the cover comprising a number of material elements between which there are open spaces whose global surface prevails over the global surface of said material elements, thus forming a cage structure.

2. A cage box as set forth in claim 1, wherein said material elements of the box walls have at least approximately a circular cross-section.

3. A cage box as set forth in claim 1, wherein said material elements of the box walls have at least approximately a trapezoidal cross-section.

4. A cage box as set forth in claim 1, comprising portions having no open space extending along the vertical edges of the body.

5. A cage box as set forth in claim 1, having a length considerably larger than its width, comprising portions having no open space extending at intervals transversally with respect to the body.

6. A cage box as set forth in claim 5, comprising separation walls formed at said portions having no open space.

7. A cage box as set forth in claim 1, comprising massive rims extending all around the body and the cover respectively, said material elements terminating at said massive rims and said lamellar hinges being connected to said massive rims.

8. A cage box as set forth in claim 7, comprising a plaque projecting downwards from said massive rim of the cover at the side opposite said lamellar hinges, said plaque having, on the inner side, projections adapted to engage, by an elastic snap action, below said massive rim of the box body, thus forming a closure clip.

9. A cage box as set forth in claim 1, having outer projections extending from the bottom wall of the box body, and forming support feet for the box.

* * * * *